United States Patent [19]

Sjogren

[11] Patent Number: 4,749,077

[45] Date of Patent: Jun. 7, 1988

[54] PUSHER ASSEMBLY FOR A TURNTABLE EMPLOYING PLURAL STEPPER MOTORS

[75] Inventor: Christer Sjogren, Miami, Fla.

[73] Assignee: Quipp, Incorporated, Miami, Fla.

[21] Appl. No.: 37,536

[22] Filed: Apr. 13, 1987

Related U.S. Application Data

[63] Continuation-in-part of Ser. No. 707,494, Mar. 1, 1985, Pat. No. 4,678,387.

[51] Int. Cl.[4] ..... B65G 47/24

[52] U.S. Cl. ..... 198/412; 198/726; 414/31; 414/46

[58] Field of Search ..... 198/412, 631, 726, 628, 198/465.3; 414/31, 43, 47; 104/35; 414/46

[56] References Cited

U.S. PATENT DOCUMENTS

| | | | |
|---|---|---|---|
| 4,014,428 | 3/1977 | Ossbahr | 198/465.3 X |
| 4,068,567 | 1/1978 | Allison et al. | 414/31 |
| 4,678,387 | 7/1987 | Stogren et al. | 414/47 |

*Primary Examiner*—Robert J. Spar
*Assistant Examiner*—D. Glenn Dayoan
*Attorney, Agent, or Firm*—Louis Weinstein

[57] ABSTRACT

In a stacker turntable used to form compensated bundles, a drive assembly for moving completed bundles off of the turntable comprises first and second drive motors mounted to the underside of the rotatable turntable at equally distant locations from the center line and as close thereto as is practicable to minimize the offcenter mass. The locations of the motors are balanced to balance the rotatable mass. Each motor drives a "picket fence" assembly, each assembly being a movable wall formed of individual vertical slats. Pusher elements are arranged at spaced distances among the slats to cooperatively form end guides for supporting bundles as they are being formed and during the time that they are rotated for pushing a completed bundle off of the turntable.

The leadlines of the motors extend through a hollow center support and coaxial with the turntable center of rotation to prevent any whipping of the leads during turntable rotation.

Each motor comprises a stepper motor which is accurately stepped during operation to assure cooperative synchronous movement and further to provide simple adjustment of any undesirable offset condition and to simplify initialization thereof. Novel mounting assemblies provide simple, straightforward tension adjustment for the timing belts coupling each motor to its associated "picket fence" drive gear.

25 Claims, 10 Drawing Sheets

PUSHER ASSEMBLY FOR A TURNTABLE EMPLOYING PLURAL STEPPER MOTORS

This application is a continuation-in-part of application Ser. No. 707,494 filed Mar. 1, 1985 now U.S. Pat. No. 4,678,387.

FIELD OF THE INVENTION

The present invention relates to stacker turntables and more particularly to a novel drive assembly for driving the turntable pushers through a dual motor technique.

Background of the Invention

Signature stackers are used for counting and stacking signatures, such as newspapers and typically include a turntable assembly for forming compensated bundles which includes a turntable having a pair of movable "picket fence" assemblies each further including a plurality of pusher/gates which cooperate with the "picket fence" assemblies to form a receiving pocket for receiving and supporting signatures delivered to the turntable, for preventing the signature stacks from toppling during the time that the turntable is rapidly rotated and to deliver signature bundles from the turntable upon their completion.

Compensated bundles are formed by depositing a plurality of signature stacks to the turntable which collectively form the bundle and by rotating the turntable through one-half turn between such deposits so that the folded edges of each stack lie on opposite parallel sides relative to the folded edges of adjacent deposited stacks.

In one preferred embodiment, the turntable is preferably mounted to rotate about a vertical axis and is driven by a cylinder assembly through one-half revolution. The turntable is rotatably supported to the stacker frame by a hollow support structure rotatably mounted to the stacker support frame by suitable bearings. A motor is secured to the rotatable support frame for rotating both "picket fence" assemblies. Rotation of the motor, together with the rotatable turntable support may inadvertently operate the "picket fence" assemblies. In the event that the "picket fence" assemblies are misaligned, there is no automatic technique for realigning them. In addition thereto, the motor leads, which are offcenter in the conventional design, tend to "whip" causing undue wearing and damage thereto.

Brief Description of the Invention

The present invention is characterized by a turntable which utilizes a pair of stepper motors having output shafts which lie upon a common diameterof the turntable, each motor being independently coupled to an associated "picket fence" drive pulley by a timing belt. Drive means are utilized for stepping each motor very accurately. The motors are located as close as is practicable to the turntable axis of rotation to reduce the amount of mass at a distance from the axis of rotation. Since the individual stepper motors do not rotate about their longitudinal axes but simply revolve about the central axis of the turntable, any possibiity of rotation of the "picket fence" drive gears is eliminated.

The electrical connecting leads from the stepper motors extend directly through the center of the hollow turntable rotatable mounting and are aligned with the center line of the turntable axis to eliminate substantially all movement of the wires, whereby any "whipping" of the wires is eliminated. In the aforementioned conventional system, the wires cannot pass through the center and must be extended downwardly, offset from the central axis and thereby be subjected to being whipped around.

In a preferred embodiment, two separate drive circuits are utilized for driving the stepper motors. However, in an alternative arrangement, a single common driver may be utilized without any reduction in the driving accuracy.

Each motor is preferably provided with its own microprocessor whereby each motor can undergo a "housekeeping" mode for automatically zeroing the location of the motor shafts and hence of the "picket fence" assemblies preparatory to operation of the stacker.

The electronic controls preferably include a microprocessor for operating an indexer which drives the driver circuits for driving each stepper motor. The motors are hung downwardly to be as close as possible and aligned with the pulleys of the "picket fences".

Digital techniques are preferably utilized to select the movement profile which, in one preferred embodiment, is typically comprised of a ramping up, cruising speed, and ramping down of the "picket fence".

Easily adjustable movable guide assemblies slidably mount the motors beneath the turntable and permit simple and yet positive tension adjustment of the timing belt pulleys.

Objects of the Invention and Brief Description of the Figures

One object of the present invention is to provide drive means for the picket fence/pusher/gate assemblies employed in a stacker turntable utilizing separate motor means.

Another object of the present invention is to provide digital drive means for the picket fence/pusher/gate assemblies drive motors to obtain the desired speed profile.

Still another object of the present invention is to provide separate motor drives for the picket fence/pusher/gate assemblies of a stacker turntable in which the motors are arranged along an imaginary diameter of the turntable axis of rotation and the motor leads are arranged co-axial with the axis of turntable rotation to prevent whipping and damage thereto.

Still another object of the present invention is to provide independent stepper motors for operating the picket fence/pusher/gate assemblies of a stacker turntable which are capable of being indpendently initialized to assure proper alignment and operation thereof.

Still another object of the present invention is to provide a novel mounting assembly for adjustably mounting the drive motors employed in a stack turntable assembly for driving the pusher/gates.

The above, as well as other objects of the present invention will become apparent when reading the accompanying description and drawings in which.

Figure 1:
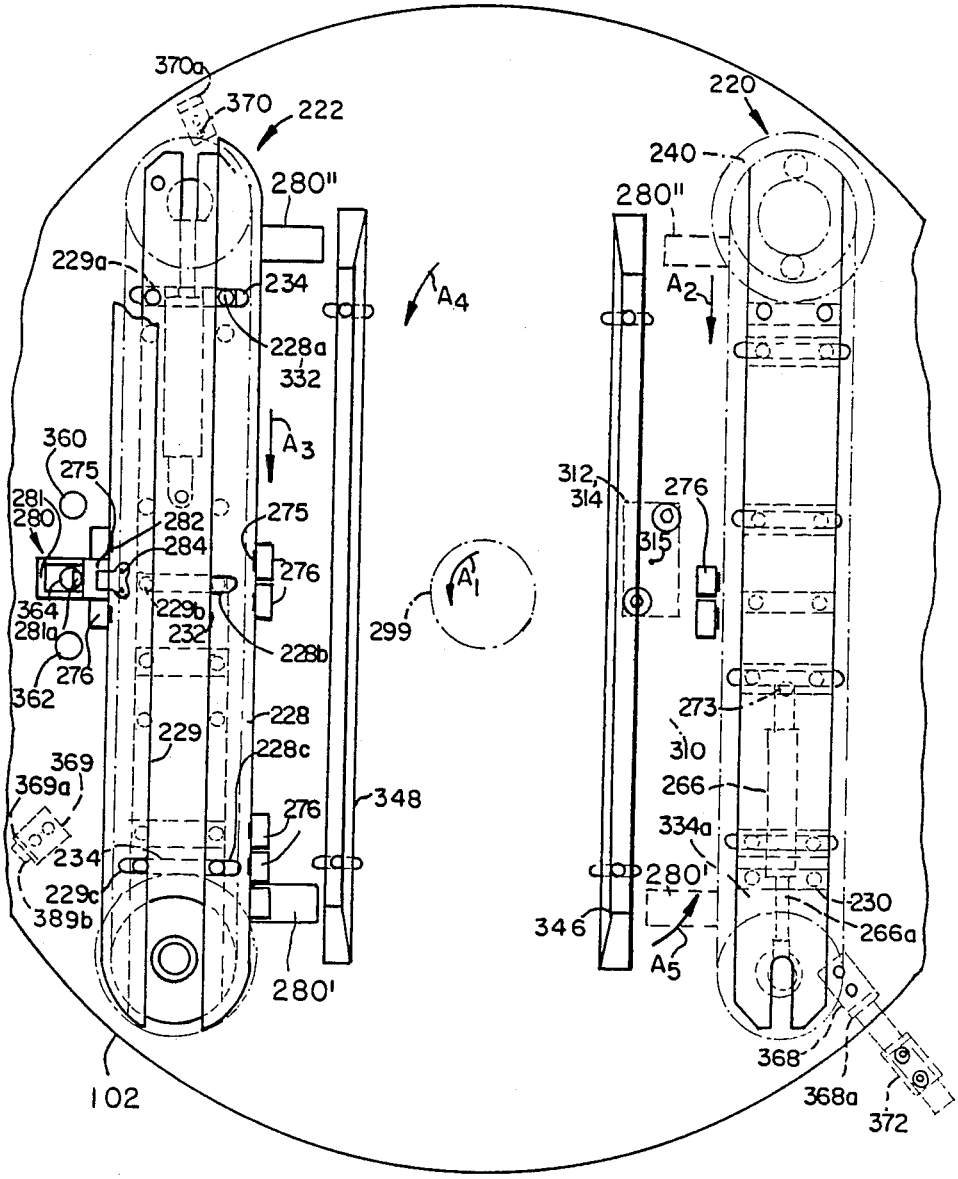
FIG. 1 shows a top plan view of a turntable embodying the principles of the present invention.

FIGS. 2*a*, 2*b* and 2*c* show detailed views of the position sensing assembly shown in FIG. 1.

Figure 3:
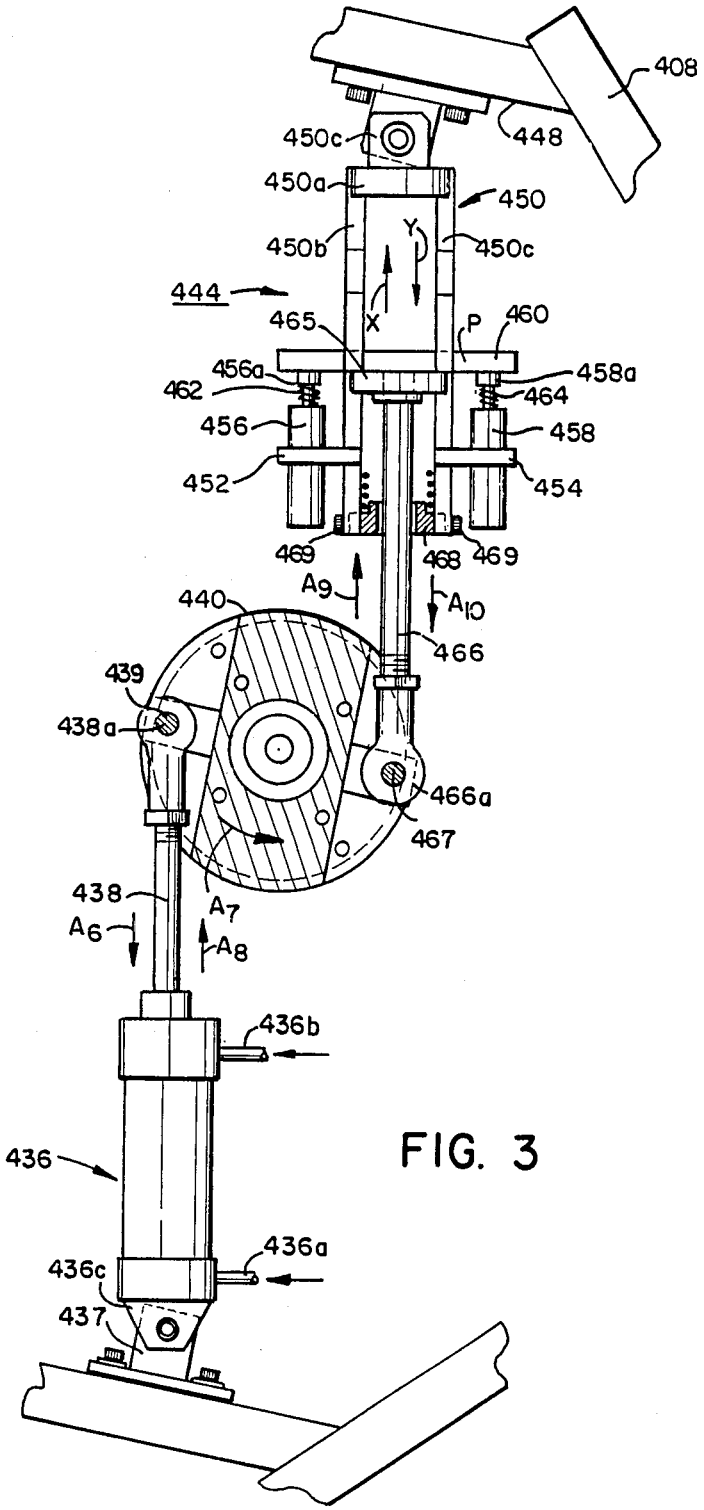

FIG. 3 shows a detailed plan view of the drive assembly for rotating the turntable of FIG. 1.

Figure 3A:
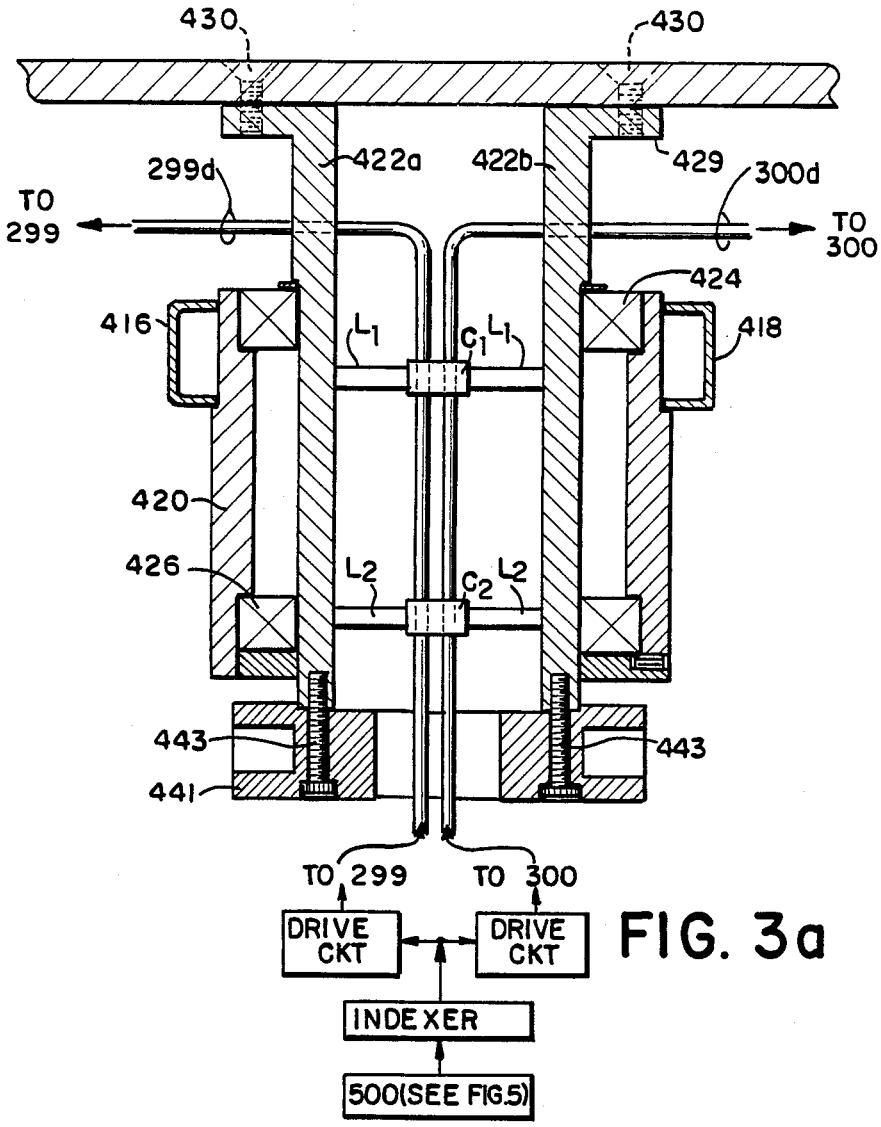

FIG. 3*a* is a sectional view showing the manner in which the motor leads extend to their drive circuits.

FIG. 3*b* shows a schematic of the valve assembly for controlling the cylinder of FIG. 3.

Figure 4C:
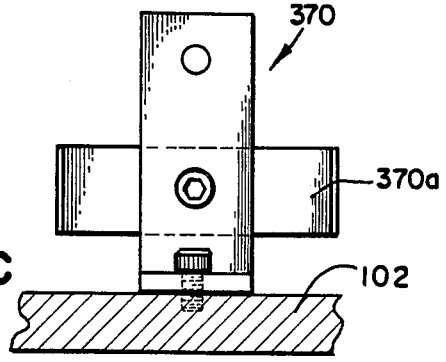
Figure 4:
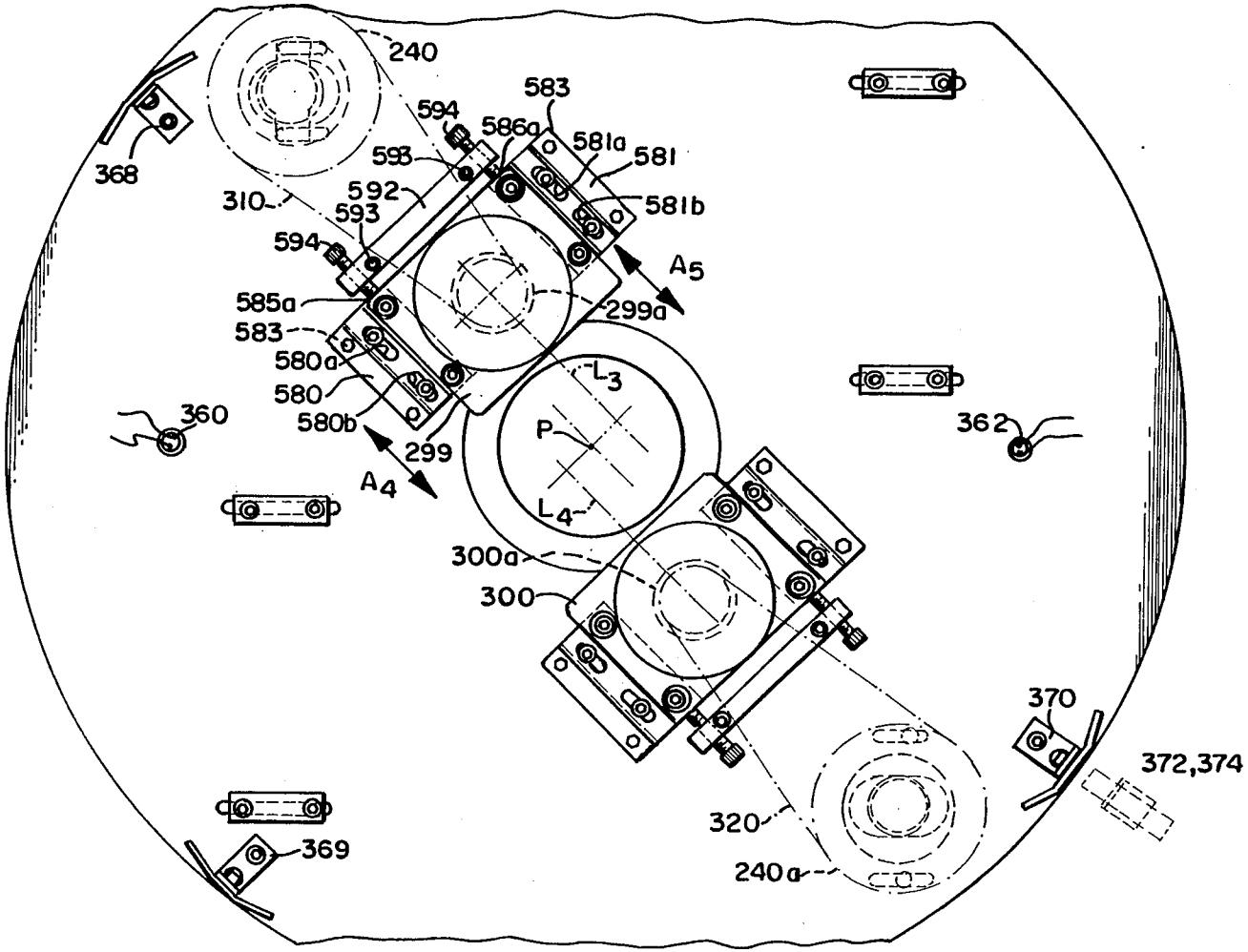

FIG. 4 shows a detailed top plan view of a drive assembly for driving the picket fence/pusher/gate assemblies.

Figure 4A:
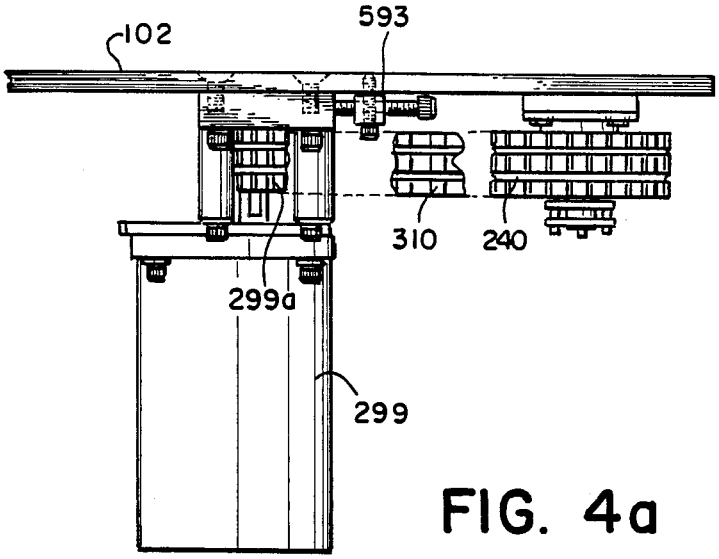
Figure 4B:
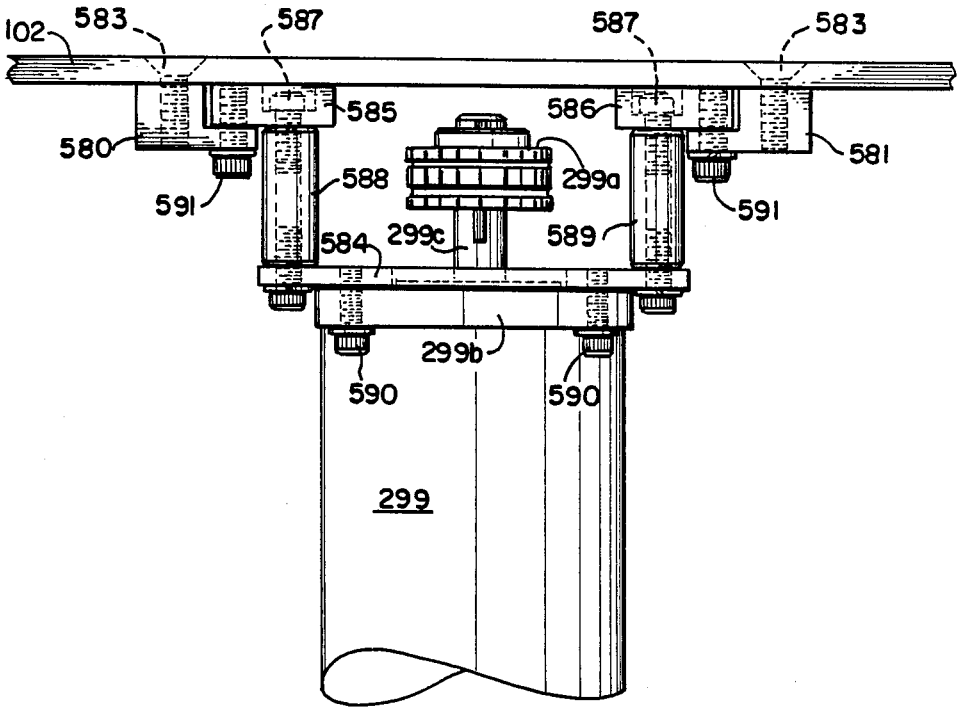

FIGS. 4*a*, 4*b* and 4*c* show elevational views of the drive assembly of FIG. 4 respectively looking in the direction of arrows A—A, B—B and C—C. of FIG. 4.

Figure 5:
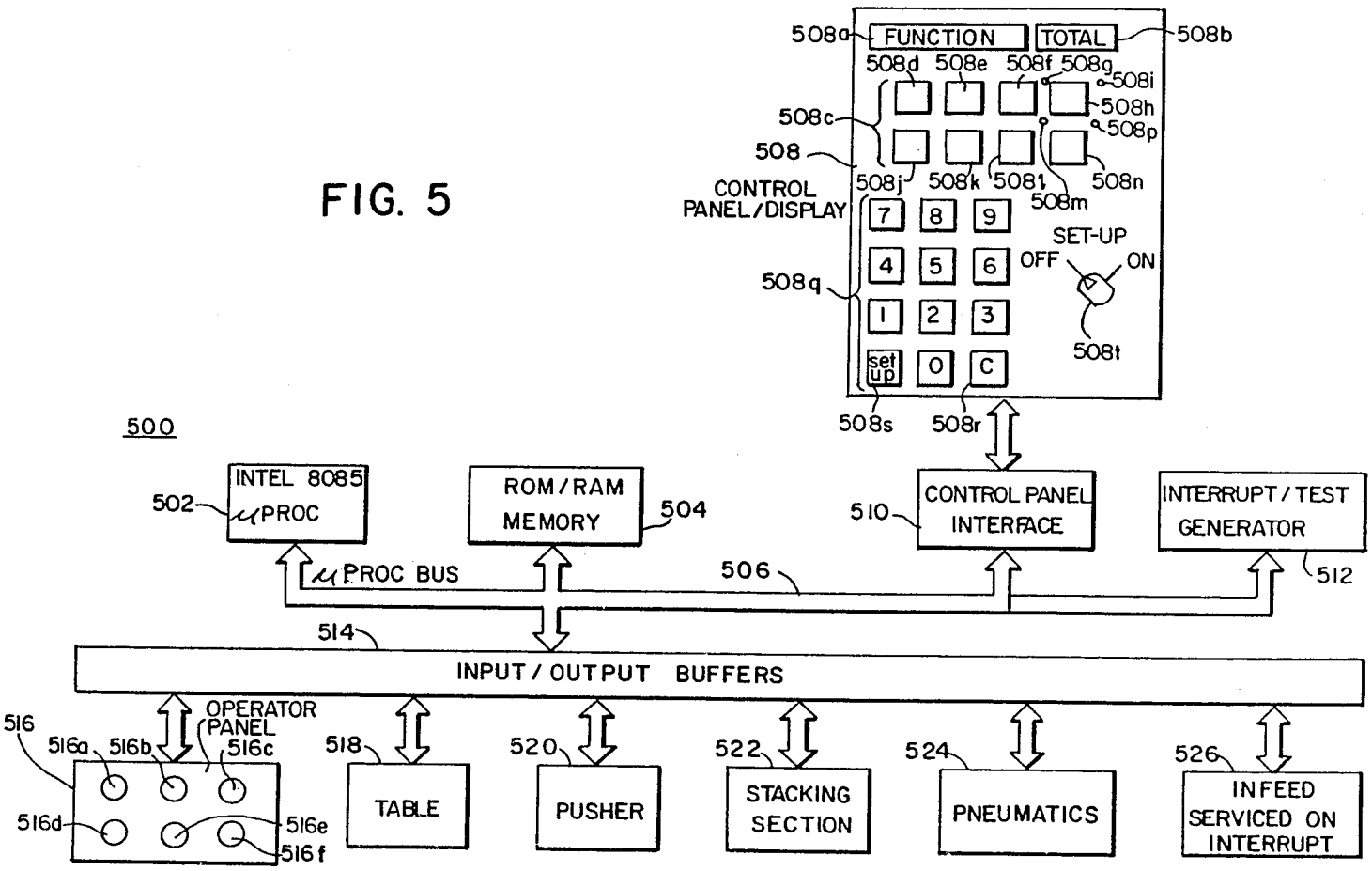

FIG. 5 is a block diagram of the control circuitry for operating the drive assembly of FIG. 4.

Figure 5A:
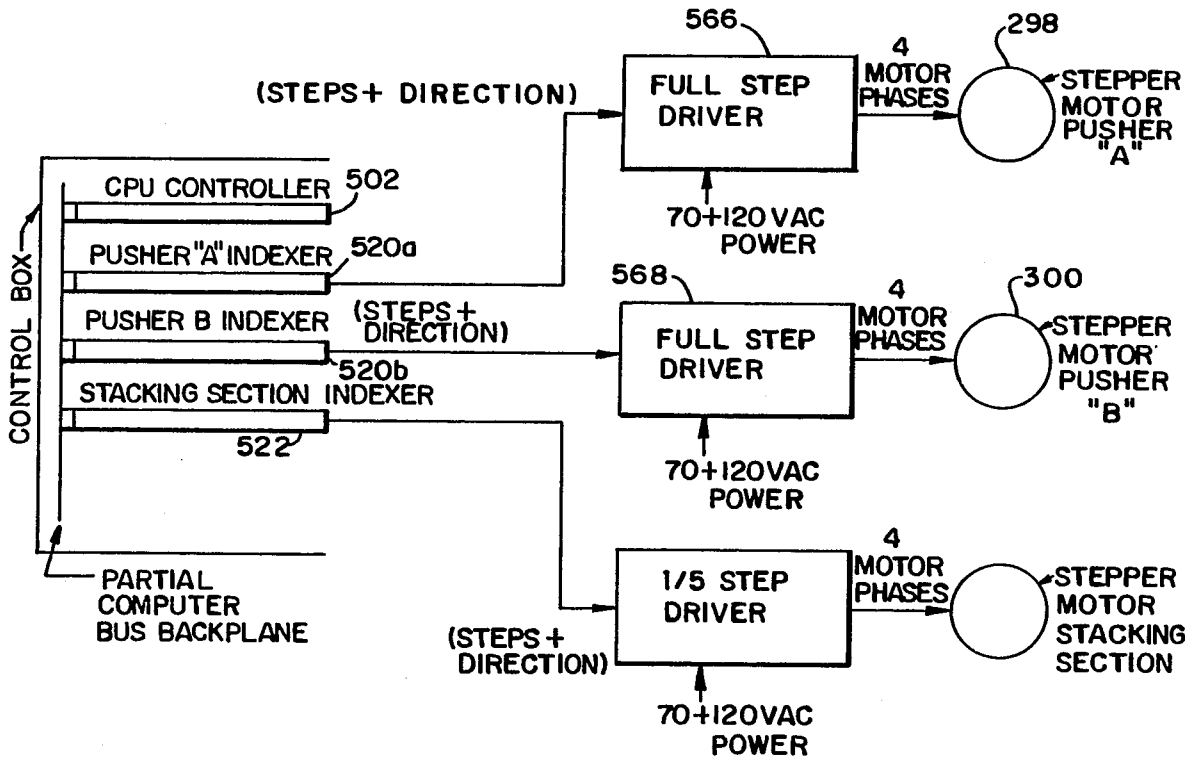

FIG. 5*a* shows some of the control blocks of FIG. 5 in greater detail.

Figure 6:
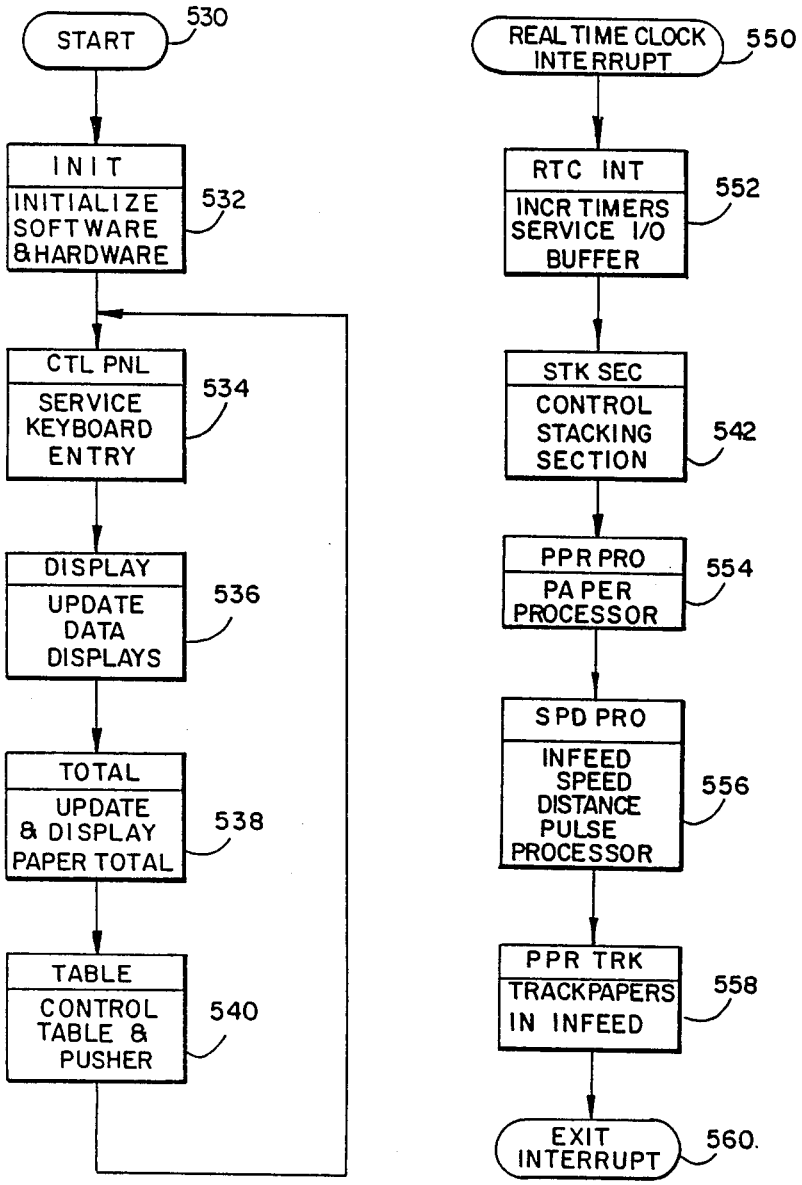

FIG. 6 is a flow diagram showing part of the operating program for the stacker employing the turntable assembly of FIG. 1.

Figure 7:
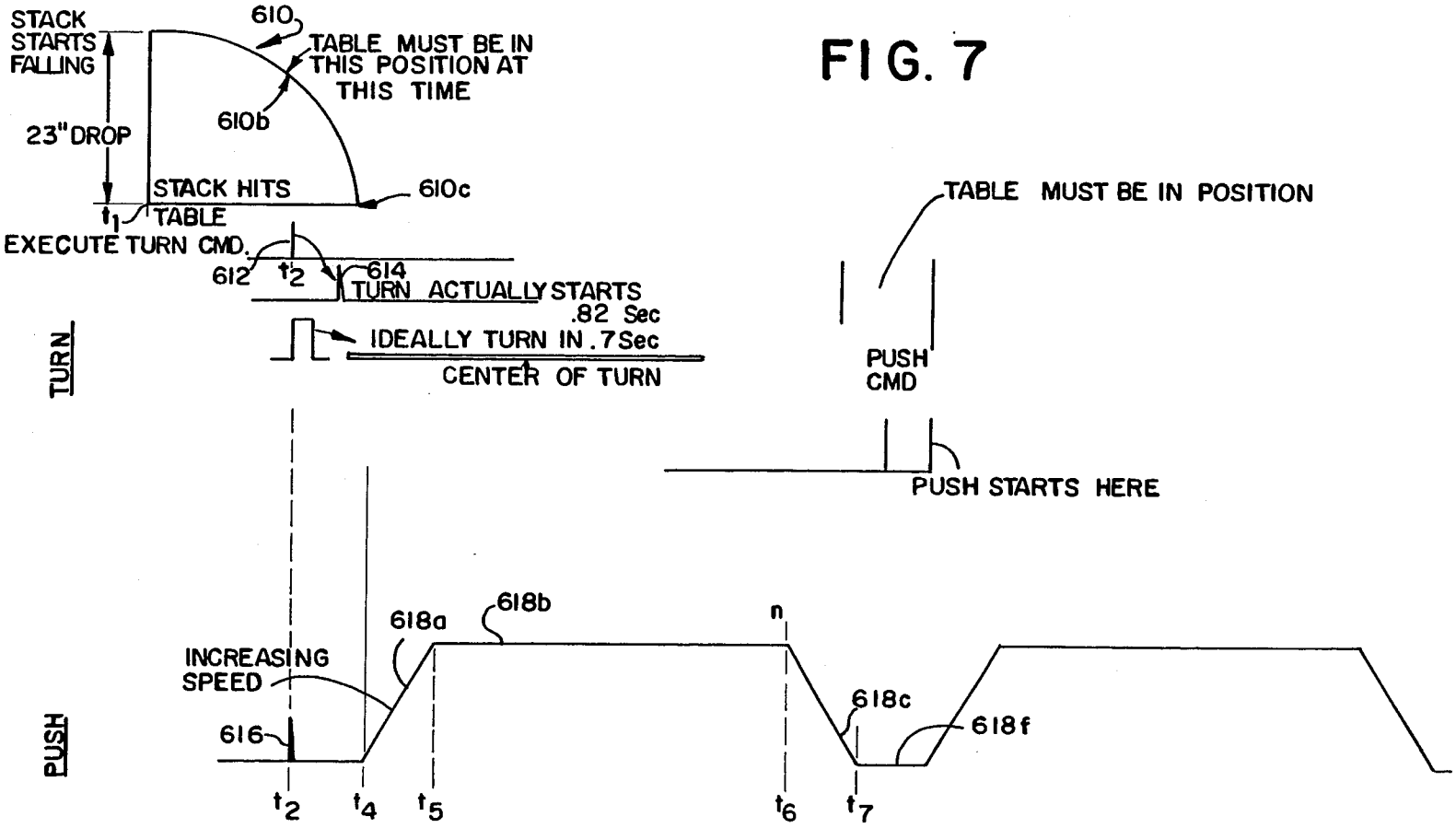

FIG. 7 is a waveform diagram useful in explaining the operation of the turntable assembly of FIG. 1.

Detailed Description of the Invention and the Preferred Embodiments Thereof

The present invention may be used in a variety of signature stackers, one of which is described in detail in copending application Ser. No. 707,494 filed Mar. 1, 1985, now U.S. Pat. No. 4,678,387. assigned to the assignee of the present invention.

Figure 2:
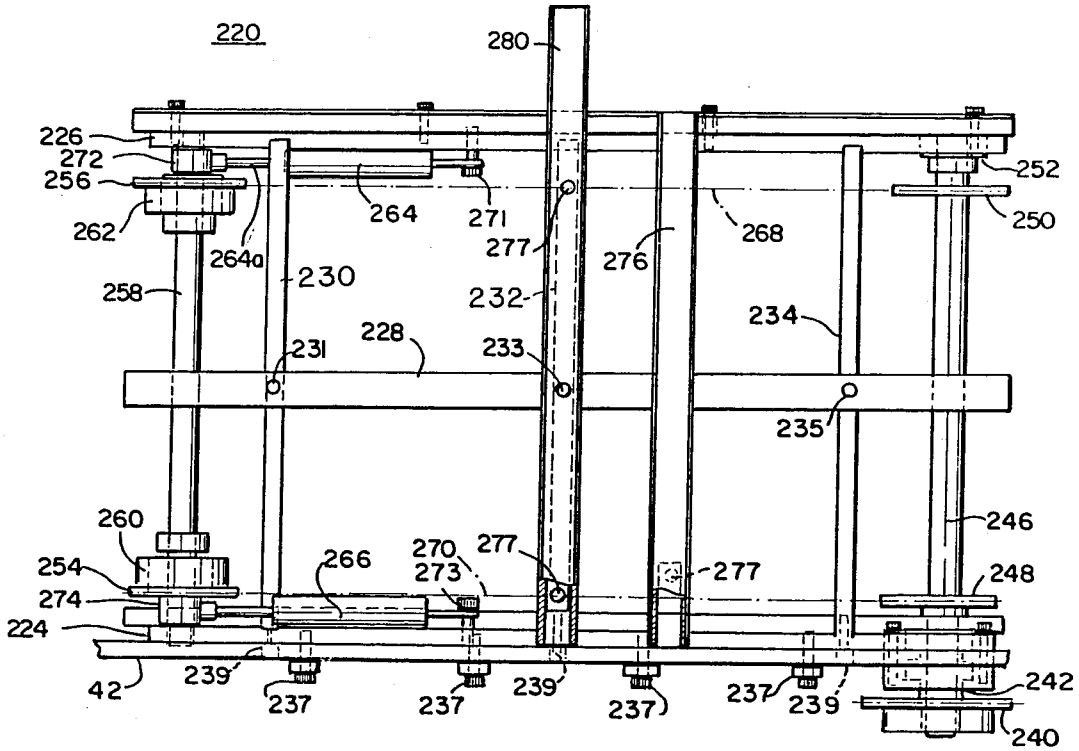
FIG. 2 shows an elevational view of one of the "picket fence" assemblies employed in the turntable assembly of FIG. 1.

The turntable assembly 100 as shown in FIGS. 1 and 2 is comprised of a unitary circular turntable 102 formed of a suitable metallic material, the turntable being rotatably mounted in a manner to be more fully described. A pair of movable support assemblies 220 and 222 are each arranged upon the turntable 102, and extend upwardly therefrom and are arranged in spaced parallel fashion relative to one another to define a pair of upright, movable side walls for receiving stacks of signatures therebetween. Since each of these assemblies is substantially identical to one another in both design and function, only one of said assemblies will be described herein in detail for purposes of simplicity.

Noting especially FIGS. 1 and 2, movable side wall assembly 220 is comprised of lower and upper plates 224, 226 maintained in a spaced parallel fashion by means of a supporting frame comprised of a pair of vertically aligned cross-pieces 230, 232 and 234 thereto. FIG. 2 shows an elevational view of the frame comprised of these cross-pieces while FIG. 1 is a top plan view showing the manner in which the horizontal cross-pieces 228 and 229 are joined to vertical cross-pieces 230 through 234. The horizontal cross-pieces 228 and 229 are provided with slots 228*a*, 228*b*, 228*c* and 229*a*, 229*b* and 229*c* for receiving the end portions of the vertically aligned plates 230, 232 and 234 respectively. Slot 229*a* has been removed from FIG. 1 for purposes of exposing elements arranged therebeneath. Fasteners 231, 233 and 235 join cross-piece 228 to the vertically aligned frame pieces 230, 232 and 234. Similar fastening means secure cross-piece 229 to these vertically aligned frame members.

Frame member 224 is secured to turntable 102 by a plurality of fasteners 237. Vertically aligned frame members 230, 232 and 234 are joined to turntable 102 and lower plate 224 by means of fasteners 239.

The pulley 240 (to be more fully described) couples drive to the pair of chains 270, 268 (shown by chain lines) supported by the aforementioned frame assembly through coupling 242 rotatably journaled within bearing 244. The coupling assembly 242 further includes shaft 246 having sprocket 248 mounted to its lower end and sprocket 250 mounted to its upper end. The upper end of shaft 246 is journaled within bearing 252 arranged within upper plate assembly 226.

A pair of idler sprockets 254 and 256 are secured to idler shaft 258 journaled within bearings 260 and 262.

Upper and lower gas spring assemblies 264 and 266 urge shaft 258 toward the left relative to FIG. 2. An upper drive chain 268 is entrained about sprockets 250 and 256. A lower drive chain 270 is entrained about sprockets 248 and 254. Drive chains 268 and 270 have been shown in schematic fashion for purposes of simplifying FIGS. 1 and 2.

Fastening means 271 and 273 secure the right-hand ends of gas springs 264 and 266 to their respective mounting plate assemblies 226 and 224. The pistons 264*a* and 266*a* of gas springs 264 and 266 urge collars 272 and 274 and hence shaft 258 to the left to maintain drive chains 268 and 270 under the proper tension. Other tension maintaining devices may be employed if desired.

A plurality of elongated slats 276, only one of which is shown in FIG. 2 are secured near their upper and lower ends to the upper and lower drive chains 268 and 270, respectively. Each link of the drive chains 268 and 270 is provided with an outwardly extending integral tab 275 having an opening for receiving a fastener 277 for securing each slat to the upper and lower chains. The slats 276 are arranged in closely spaced parallel fashion to collectively form a movable wall. Three gate/pusher assemblies, 280, 280' and 280" are arranged at equispaced intervals along the movable wall and are affixed at their upper and lower ends to drive chains 268 and 270 by fastening means 277. Since all the gate/pushers are substantially identical, for purposes of simplicity only gate/pusher 280 will be described in detail. Considering FIG. 1, the gate/pusher 280 is comprised of a substantially U-shaped elongated resilient (i.e. rubber or rubber-like) portion 281 secured to an elongated mounting or base portion 282 having a link 284 forming an integral part of its associated drive chain and having a tapped opening coaligned with an associated opening in base member 282 for receiving a threaded fastener 281*a* to secure the base member and hence the gate/pusher to the chain. Noting FIG. 2, it can be seen that the height of each gate/pusher is greater than the height of the slats 276. The rear edges of the slats 276 and gate pushers 280 through 280" slideably engage the adjacent surfaces of plates 228 and 229 to maintain those slats and gate pushers presently positioned between the center lines of the sprockets 250, 262 and 248, 254 in a straight line.

The pair of movable sidewall assemblies 220, 222 are moved when it is desired to push a completed compensated (or uncompensated) bundle off of the turntable 102 and onto an adjacent conveyor (not shown). The power train for accomplishing this movement is comprised of pair of stepper motors.

As will be described in detail hereinbelow, each of the movable side wall assemblies 220 and 222 is driven by separate, independent timing belts respectively coupled with and driven by the pulleys 299*a*, 300*a* of stepper motors 299, 300. For example, movable side wall assembly 222 (see FIGS. 1, 4 and 4*a*) is provided with pulley 240 which lies in the same horizontal imaginary plane as pulley 299*a*. A timing belt 310 is entrained about pulley 299*a* and pulley 240. Assuming that pulley 299 rotates in the direction shown by arrow $A_1$ shown in FIGS. 1 and 4 the drive chains forming the movable side wall assembly 222 will move in the direction appropriate for movement of the pulley 299.

Timing belt 320 is entrained about pulley 300*a* of motor 300 and pulley 240*a*. Pulleys 300 and 240*a* lie within the same imaginary horizontal plane. Pulleys 300*a* and 240*a* rotate in directions so that the drive chains making up movable wall assembly 220 will move in the direction shown by arrow $A_2$ which is the same direction of movement of sidewall assembly 222, as shown by arrow $A_3$ (FIG. 1). Thus, the pushers 280', 280" of movable wall assemblies 220 and 222 cooperate to push a compensated (or uncompensated) signature bundle supported on turntable 102 between the two side wall assemblies 220, 222 in the direction shown by arrows $A_2$ and $A_3$ onto an adjacent conveyor (not shown for purposes of simplicity) for subsequent handling and to position the turntable assembly 100 and assemblies 220, 222 in readiness for the receipt and formation of the next compensated bundle.

In operation, the stepper motors 299, 300 are energized to abruptly accelerate their aforementioned pulleys 240, 240*a* whereby the picket fence assemblies are moved in the direction shown by arrows $A_2$, $A_3$.

Each of the stepper motors 299, 300 and hence their pulleys 299*a*, 300*a* are movable in order to adjust the tension of the timing belts 310, 320. Since the mounting assemblies for the stepper motors are identical to one another in both design and function, the description will be limited to the mounting assembly for stepper motor 299. As shown in FIGS. 4*a* and 4*b*, a pair of elongated plates 580, 581 having a substantially L-shaped cross-section, are secured to the underside of turntable 102 by fasteners 583. A platform 584, which is a substantially rectangular-shaped plate having a central opening 584*a* is mounted to a pair of elongated rectangular-shaped plates 585, 586 by threaded fasteners 587 and tapped, hollow, cylindrical-shaped spacers 588, 589. Flange 299*b* of motor 299 is bolted to platform 584 by fasteners 590. Pulley 299*a* is secured to stepper motor output shaft 299*c*.

Elongated rectangular-shaped plates 585, 586 are secured to L-shaped plates 580, 581 by threaded fasteners 591 which threadedly engage tapped openings in plates 585, 586. Elongated clearance openings 580*a*, 580*b*, and 581*a*, 581*b* are provided in L-shaped plates 580, 581 for receiving fasteners 591 to permit movement of plates 585, 586 in the linear directions shown by double-headed arrows $A_4$ and $A_5$ in FIG. 4.

Elongated plate 592 is secured to the underside of turntable 102 by suitable fastening members 593. A pair of tapped openings are provided in block 592 for receiving bolts 594, the free ends of which engage adjacent ends 585*a*, 586*a* of plates 585, 586 for ultimately moving platform 584 and hence stepper motor 299 in order to maintain timing belt 310 under proper tension. The use of timing belts 310, 320 and timing belt pulleys 299*a* and 240 assure accurate movement of the picket fence/pusher/gate assemblies. Each stepper motor is provided with its own microprocessor. Due to the possibility that one stepper motor could be out of step with the other, it is thus possible to use a "housekeeping" technique in the controller microprocessor for zeroing the stepper motors in order to properly align the gate/pushers 280 through 280".

The stepper motors 299, 300 are hung downwardly and are arranged adjacent to their associated "picket fence" driver pulleys.

The use of digital techniques allows selection of any desired profile of ramping up, cruising speed and ramping down of the "picket fence".

The motors are also preferably located as close as possible to the axis of rotation of turntable 102 to reduce the amount of mass which is located at a distance from the axis of rotation. The axes of rotation of the stepper motor output shafts lie on an imaginary line which passes through the center of rotation of the turntable 102. The axes of rotation of the driven pulleys 240, 240*a* lie along a second imaginary line which also passes through the center of rotation of turntable 102. These imaginary lines $L_1$ and $L_2$ are offset from one another. The imaginary lines $L_3$ and $L_4$ passing through the axes of rotation of pulleys 299*a*–240 and 300*a*–240*a* are parallel to one another. The point P representing the center of rotation of turntable 102 lies between and is equidistant from lines $L_3$ and $L_4$. This arrangement simplifies the procedure for assuring the balancing of the weight of the turntable.

The electrical leads from 299*d*, 300*d* from the stepper motors 299, 300 extend through openings 422*a*, 422*b* in hollow rotatable member 422, as shown in FIG. 3*a*. Leads 299*d*, 300*d* are arranged along the axis of rotation of the turntable 102 by suitable centering means such as collars $C_1$, $C_2$ maintained so that their centers are coaxial with the longitudinal axis of cylindrical member 422 by means of a plurality (preferably 3) of legs L preferably arranged at equal angular intervals and having their outer ends secured to the interior surface of cylindrical member 422 and their inner ends secured to collars $C_1$ and $C_2$. With this arrangement there is substantially no movement of the wires and "whipping" of the wires during rotation of turntable 102 is eliminated. In those prior art arrangements in which a central drive motor was employed, the wires could not pass through the center and had to be extended downwardly to the control circuitry at a location offset from the central axis and would therefore experience significant "whipping" during operation. In the preferred embodiment, two separate drive circuits are employed for operating each of the stepper motors 299, 300. As an alternative arrangement, a single central driver common to both drive circuits may be employed (see FIG. 3*a*).

A pair of elongated tapered bars 346, 348 are mounted upon turntable 102 in spaced parallel fashion and are parallel with the movable side walls as shown best in FIG. 1. The bars 346, 348 support the bottom signature so that it is maintained a spaced distance above the top surface of turntable 102 to prevent the bottom signature and hence any signatures resting upon the bottom signature from becoming wedged beneath the surface of turntable 102 and the gate/pusher arms 280–280" and/or the slots 276. As can best be understood from a consideration of FIG. 1, four of the six gate/pusher assemblies 280–280' cooperate with the movable side walls to hold a compensated signature bundle upright and prevent the signature bundle from toppling during the time that the turntable 102 is rapidly rotated through one-half revolution. The gate/pusher assemblies 280–280" then perform their "pushing" function to urge the completed compensated (or uncompensated) bundle in either direction off of the turntable 102 and on to an associated conveyor (not shown) for subsequent handling, such as, for example, tying of the bundle.

The bi-directional stepper motors 299, 300 are under control of a microprocessor to be more fully described.

The microprocessor operates motors 299, 300 at the proper time and with the proper polarity signals.

Considering FIG. 5*a*, stepper motors 299 and 300 are independently controlled modules which are each synchonized to an associated proximity switch 360 and 362 (see FIG. 4) which is identified as the home position, upon start up of the stacker. Once synchronized, each index 520*a*, 520*b* is given a predetermined number of steps that the motors are to turn, in addition to the number of steps an acceleration, velocity and direction are given to each indexer from the CPU controller 502. When a push cycle is necessary, the "distance command" is sent from the CPU 502 by way of the bus 506 to each pusher indexer 520*a*, 520*b*.

The pusher indexers are thus provided with a distance, velocity, acceleration and direction. Since the indexer knows this information it performs velocity calculations to arrive at the home position. If CPU 502 does not detect the arrival of the pusher at the proximity switch upon the end of the push cycle then CPU 502 will tell the pusher to move in the same direction at the synchronization speed until either the proximity switch detects the arrival of the pusher gate at the home position or a timer times out whereupon the stacker is shut down. The synchronized speed is slower than the normal speed and is approximately 20 percent of top speed.

The turntable 102 is further provided with three brackets 368, 369 and 370 which are spaced apart at 90 degree intervals about turntable 102 and comprised of bracket arm 368*a*, 369*a* and 370*a*. Arm 368*a* has one steel target plate 368*b* mounted in an upper position; arm 369*a* has two steel target plates at upper and lower positions; and arm 370*a* has one steel target plate at a lower position. Brackets 368, 369 and 370 occupy positions of 0°, 90° and 180° respectively about turntable 102. A pair of proximity sensors 372, 374 are mounted in stationary fashion upon the stacker frame, sensors 372, 374 being in alignment with the upper and lower positions, respectively.

Assuming that the turntable 102 occupies the 0° position shown in FIG. 1*c* and is rotated counterclockwise, steel target plate 370*a* is sensed by proximity sensor 374 while sensor 372 senses no plate to develop a signal ("0", "1") indicating that the turntable 102 is at the 0° position (FIG. 2*a*). Initially, the valve control assembly, for operating the turntable cylinder, operates to move turntable 102 at high speed. Upon completion of one-quarter revolution, i.e. at the 90° position (FIG. 2*b*) bracket 369 having steel target plates 369*b* and 369*c* moves past sensors 372, 374 which develop signals ("1", "1") to operate the valve control assembly to reduce the pressure introduced into the cylinder during the remaining 90° of the 180° revolution.

When the bracket 370 moves into alignment with sensors 372, 374 (FIG. 2*c*), the sensors develop signals ("1" "0") indicating that table is at the 180° position.

When rotating in the reverse direction, i.e. from the 180° position to the 0° position, sensors 372, 374 develop the signals ("1", "0" at 0°); ("1", "1" at 90°); and ("0", "1" at 180°).

The manner in which the turntable assembly 100 is rotatably mounted within the signature stacker (not shown) is described in detail in copending application Ser. No. 707,494 filed Mar. 1, 1985, which description is incorporated herein by reference thereto (note especially FIGS. 8, 10 and 12).

A pair of horizontally aligned cross-pieces 416, 418, arranged in spaced, parallel fashion, are secured to the cross-pieces 410 and 414 of the stacker frame (not shown) by suitable fastening means and are welded to outer cylindrical housing 420 (see FIG. 3*a*). Cross-pieces 416, 418 are shown welded to cylindrical housing 420.

Hollow cylindrical housing 420 rotatably supports a second hollow cylindrical housing 422 journaled within bearing assemblies 424 and 426 positioned between the interior wall of cylinder 420 and the exterior wall of cylinder 422.

The upper end of rotatable cylinder 422 is provided with diametrically aligned openings 422*a*, 422*b* through which the electrical conductors 292*d*, 300*d* for motors 299 and 300 extend. The upper end of inner cylinder 422 is welded to an outer ring 429 which engages and supports turntable 102.

Fasteners 430 secure plate ring 429 to the underside of turntable 102. The heads of these fasteners are flush with the top surface of turntable 102 to present a smooth, unbroken top surface which does not interfere with sliding movement of a signature across the turntable surface.

An operating cylinder 436 is provided for rotating turntable 102 (see FIG. 3). Cylinder 436 has a reciprocating piston 438 and is provided with pressure inlet openings 436*a*, 436*b* for the introduction of gas under pressure to operate cylinder 436. The free end of cylinder 438 is provided with eyelet 438*a* for receiving a pin 439 which swingably mounts piston 438 to a cylindrical-shaped mounting assembly 440.

A shock absorber assembly 444 is comprised of a substantially U-shaped mounting assembly 450 having a first end 450*a* swingably mounted to a diagonally aligned cross-piece 448 joined to the horizontally aligned cross-pieces 408 and 414. The bifurcated arms 450*b* and 450*c* of mounting assembly 450 are each provided with a mounting bracket 452, 454 secured thereto by any suitable means, each bracket being adapted to position and support a hydraulic cylinder 456, 458 respectively. Each hydraulic cylinder includes a piston 456*a*, 458*a*. The free end of each piston is secured to the opposite ends of a movable plate 460 arranged to slide within elongated slots (not shown) provided within bifurcated arms 450*b*, 450*a*. Helical springs 462, 464 surround the exposed portion of an associated piston rod 456*a*, 458*a*. A collar 465 is joined by bifurcated arms 450*a*, 450*b* and slideably receives an elongated shaft 466 which is further slideably supported by means of a second cylindrical member 468 joined to the lower ends of bifurcated arms 450*b*, 450*a* by fasteners 469. The free end of shaft 466 is provided with a eyelet 466*a* which is swingably mounted to the mounting assembly 440 by pin 467.

The rotation of the turntable 102 through one-half revolution is performed as follows:

Air under pressure (in the preferred embodiment at a pressure of 90 PSI) is introduced into inlet 436*b* of cylinder 436 causing the piston 438 to move in the direction shown by arrow $A_6$ thereby rotating mounting assembly 440 in the counterclockwise direction as shown by arrow $A_7$. At this time opening 436*a* is coupled to an exhaust outlet. This operation of cylinder 436 causes mounting assembly 440, inner rotatable cylinder 422 and turntable 102 to begin rotation. The turntable 102 accelerates rapidly and, as it completes one-quarter revolution, sensors 372 and 374 develop the signals ("1", "1") causing the decoupling of 90 PSI from inlet 436*b* and coupling inlet 436*b* to the exhaust outlet and decoupling inlet 436*a* from the exhaust outlet and coupling inlet 436*a* to a pressure source having a pressure of the order of 30 PSI. At the time that movable assembly 440 moves through one-quarter revolution, piston 438 stops moving in the direction of arrow $A_6$ and starts moving in the direction shown by arrow $A_8$. To sustain this movement through other than just the inertia of the mechanical parts, the 30 PSI pressure source moves the turntable from the quarter turn position to the half turn position. The 30 PSI pressure source remains coupled to the air cylinder until the next turn cycle. The turntable is abruptly halted by the shock absorber assembly 444.

An assembly 440 is rotating under control of cylinder 436 and piston 438, shaft 466 is moved in the direction shown by arrow $A_9$ which moves plate 460, causing pistons 456*a* and 458*a* to move out of their cooperating hydraulic cylinders 456 and 458.

When the movable assembly 440 has rotated through one-quarter turn, shaft 466 stops moving in the direction shown by arrow $A_9$ and starts to move in the direction shown by arrow $A_{10}$ whereupon plate 460 and pistons 456*a* and 458*a* move in the same direction causing the hydraulic fluid within hydraulic cylinders 456 and 458 to undergo compression. The nature of the hydraulic fluid is such that after the turntable has moved through approximately 135 degrees of rotation the hydraulic cylinders are caused to rapidly decelerate mounting assembly 440 and hence turntable 102, causing the turntable to be rapidly halted after it has rotated through 180 degrees. The sensors 372 and 374 sense rotation through this angle to detect the completion of the turntable rotation through 180 degrees.

Upon completion of rotation of the turntable through 180 degrees, pin 439 now occupies the position previously occupied by pin 467, and vice versa. Thus, the next time that turntable 102 is rotated it will be rotated in the direction opposite to the direction shown by arrow $A_7$. Turntable 102 is thus alternately rotated in the clockwise and counterclockwise direction after the delivery of each signature stack.

The pressure coupling assembly 380 is shown in FIG. 5 together with cylinder 436 and piston 438. The pressure coupling assembly 380 is a movable assembly having integral halves 472 and 474 spring biased by spring 476 so as to normally maintain the position shown in FIG. 5. A first inlet conduit 478 is coupled to a 90 PSI pressure source. A second conduit 480 is coupled to a 30 PSI pressure source. A third conduit 482 is coupled to an exhaust vent. Assembly half 472 is provided with a sealed opening 472*a* a one-way valve passageway 472*b* and a one-way valve passageway 472*c*. Integral half 474 is provided with a one-way valve passageway 474*a*, a second one-way valve passageway 474*b* and a sealed passageway 474*c*. Conduits 484 and 486 couple selected passageways to inlets 436*b* and 436*a* respectively. A solenoid relay 488 operates to selectively move the movable assembly in the following manner:

Assuming that solenoid relay 488 is de-energized, spring 476 normally urges the movable assembly to the position shown in FIG. 3*b*, whereby sealed opening 472*a* seals the conduit 478 coupled to the 90 PSI source. One-way passageway 472*c* is in alignment with conduits 480 and 486 coupling the 30 PSI source to cylinder inlet 436*a*. One-way passageway 472*b* is aligned with conduits 484 and 482, allowing air under pressure to leave cylinder inlet 436*b* and be exhausted through conduit 482.

Upon energization of relay solenoid 488, the movable assembly is moved in the direction shown by arrow $A_{10}$ to move one-way passageway 474*a* into alignment with conduits 478 and 484, coupling the 90 PSI source to cylinder inlet 436*b*. Diagonally aligned passageway 474*b* is aligned with conduits 486 and 482 causing air under pressure passing through inlet 436*a* to be exhausted through conduit 482. Conduit 480 coupled to the 30 PSI source is sealed by sealed opening 474*c*. In the event of a momentary or permanent power loss, the pressure coupling assembly returns to the position shown in FIG. 3*b*, coupling the 30 PSI source to inlet 436*a* of cylinder 436, retaining the rotatable assembly in the halted position.

The movable sidewall (i.e. "picket fence") assemblies are moved at the time that the turntable 102 is halted, and vice versa.

Motors 299 and 300 rotate with the rotation of turntable 102, the sprockets and drive chains forming part of the assembly for driving the movable sidewalls rotate in unison therewith. The movable sidewall assemblies experience no movement during rotation of the turntable.

After completion of turntable rotation through one-half revolution, and after delivery of the last signature stack to the turntable, the stepper motors 299, 300 are operated for pushing a completed compensated (or uncompensated) bundle from the turntable assembly.

A controller is utilized to assure proper timing in the operation of the stacker and its various sub-assemblies, taking into account the stacker geometry and all of the operating time delays of the various sub-assemblies. A detailed description of the stacker operation under control of the controller is set forth in copending application Ser. No. 707,494, now U.S. Pat. No. 4,678,387. The description set forth herein will be limited to operation of the turntable assembly.

Upon completion of the formation of a bundle of signatures on turntable 102 which is preferably a compensated bundle, the gate/pushers 280, 280″ (FIG. 1) are moved to push the compensated bundle off of turntable 102 in readiness for forming the next compensated bundle. The rotation of platform 102 and the movement of pushers 280, 280″ are controlled to occur at an optimum time to allow each stack dropped onto platform 102 to complete its vertical travel before any rotational (turntable) or horizontal (gate/pusher) movement is performed. This inherently provides a neater and closely packed stack. The controller, responsive to the stacking section delivering a stack of signatures to the turntable 102, controls the movement of platform 102 and pushers 280, 280″ such that either action will be completed before the next signature stack is dropped from the stacking section onto turntable 102. With this method the maximum time can be allowed for the dropped stack to complete its vertical travel regardless of the stack accumulation rate. Due to the inherent mechanical delay in the pusher/gate components due to inertia, the controller generates the push command signal prior to the actual initiation of the movement of the gate/pushers 280, 280″.

The stacking platforms (not shown) delivering stacks to turntable 102 and the stepper motors moving the gate/pushers are monitored to control the speed of the respective drive chains in accordance with a predetermined pattern.

The stepper motors 299, 300 shown in FIG. 4, for example, and employed for moving the gate/pushers 280, 280" shown in FIG. 1, are operated in such a fashion that the controller applies pulses at a rate to initially develop an ascending ramp signal to motors 299, 300 to rapidly accelerate the gate/pushers 280, 280". After a predetermined interval, the controller thereafter applies signals at a constant rate to motors 299, 300 for a predetermined interval to maintain rotation of pulleys 299*a*, 300*a* at a constant velocity. The controller then applies pulses at a descending rate to develop a descending ramp signal to motors 299, 300 to bring the gate pushers to a halt at the home position. The CPU 502 examines the home sensor 360 (or 362) to determine if the gate/-pusher has reached the home position. If not, the pusher stepper motor is operated at synchronized speed moving in the same direction and a timer is set. If the gate/-pusher has not arrived at the home position before the timer times out, the stacker is shut down.

The control system automatically controls the initiation of the turn and push operations. A turn operation is initiated after the drop of each stack of a compensated bundle except for the drop of the last stack forming the compensated bundle. A push operation is initialed a predetermined delay interval after a single stack bundle or the last stack of a compensated bundle has collected upon turntable 102.

The turn command signal is generated after a delay interval has elapsed responsive to the dropping of a stack from the stacking section of the stacker. Although the condition which initiates the turn operation is always the same, the time at which this condition is reached varies as a function of the speed of the stacking platforms in the stacking section delivering signature stacks to turntable 102. The aforementioned delay period is sufficient to allow the signatures forming the stack to drop and settle upon the platform 102, also taking into account the inherent delay in the mechanical components of the turntable, thereby enabling a reduction of the electronic delay to start turning turntable 102.

The push command is also initiated a predetermined delay interval after arriving at the aforementioned predetermined condition. A push command occurs upon completion of a compensated stack or after the drop of a single stack bundle upon the turntable. The push interval is a fixed time interval but its initiation varies, as was mentioned hereinabove, as a function of the stacking speed.

FIG. 5 shows a simplified block diagram of the stacker electronic control system 500 comprised of microprocessor 502 and a combined read only/random access memory (ROM/RAM) 504. The system includes a microprocessor bus 506 through control panel interface 510. An interrupt/test generator 512 is also coupled to microprocessor 502 through bus 506 for stepping the stacker through its normal operation.

An input/output buffer circuit 514 selectively transfers data to and collects data from various control and sensing devices to be described in greater detail hereinbelow. Buffer circuitry 514 is coupled to microprocessor 502 through the microprocessor bus 506.

Operating the set-up key (with the set-up switch 508*t* in the off position) allows the operator to scan through each of the parameters stored in memory (such as the push and turn delay, home position time, settling time, etc.). Moving the set-up switch 508*t* to the on position allows the stored parameters to be examined and altered. A key operated lock 508*u* prevents stored parameters from being changed by unauthorized personnel.

The basic data is inputted through control panel 508. For example, depressing bundle size key 508 causes the function display 508*a* to display the legend "BUNDLE SIZE". The total number of copies per bundle are chosen by operating the numeric keys in numeric keyboard group 508*q*. The value displayed in the total copy display 508*b* is entered by depressing enter button 508*j*. All of the values capable of being entered through the control keyboard may be cleared by operating clear button 508*r*. Operating the present values key 508*e* causes optinum values stored in firmware to be utilized as the set-up values for operation of the stacker. The optimum values include intercept delay, settling time delay, push delay and turn delay. However, these values may be substituted by values placed in changeable memory as will be more fully described.

Operating the odd count key 508*f* energizes its associated LED 508*g* and causes odd bundle counts to be determined internally or controlled by an external "dumb" or "smart" programmer. For example, if a bundle size of 122 is inputted, by selecting the odd count key, the associated program will create a bundle comprised, for example, of four (4) stacks of 25 signatures and a final stack of 22 signatures. The last stack count is also compared against both a maximum value and a minimum value to determine how to deal with the last bundle. for example, to form a bundle of 127 signatures one option is to form five (5) stacks of 25 signatures and one stack of two signatures. Comparing the value 2 against the stored minimum value (for example 15) would cause the last stack of two (which is smaller than the minimum amount) to be part of the last stack of twenty-five whereby the stacker will form four stacks of twenty-five signatures and one stack of twenty-seven signatures. A twenty-seven signature stack is compared against the stored upper limit (for example 35) and is found to be permissable.

The aforementioned parameter data is entered by operating the set-up switch 508*t* so that its arrow marker 508*u* is aligned with the "ON" position after unlocking lock 508*u*. After the set-up information is introduced (or altered) the set-up switch is rotated so that its marker 508*u* is aligned with the "OFF" position and lock 508*u* is locked.

The "Table" block 518 shown in FIG. 5 contains the control valve 518*a* provided for coupling air under pressure from an air pressure source (not shown for purposes of simplicity) to the air dispensing ports 255 arranged at predetermined locations upon the turntable 102. A second control valve 518*b* is provided for coupling air pressure to the cylinder employed for rotating turntable 102.

The circuit 520 services the stepper motors 299, 300 receiving operating signals from the microprocessor 502 for operating the gate/pushers 280–280" and further includes the sensors comprising the home position sensor 364 and two near home position sensors 360, 362 (FIG. 7) on opposite sides of the home position sensor utilized to decelerate the gate/pusher stepper motors 299, 300 to an approach speed prior to the gate/pushers reaching the home position. The motors 299, 300 are brought to an abrupt halt either by a signal to the controller when the home sensor 364 senses the gate/-pusher at the home position, or by direct control of the controller.

The flow diagram of FIG. 6 diagramatically discloses a portion of the operation of the control system which in one preferred embodiment comprises a Model 7085-1 which is a combination microprocessor, ROM and RAM manufactured by PROLOG. When the stacker start button 516 shown in FIG. 5 is depressed, the microprocessor 502 enters into the initial step 530 of the program. The program then initializes software and hardware at 532. Initialization includes moving turntable 102 to the ready position and moving the gate/pushers to the start position. The movement of the gate/-pushers assures that any bundle or bundle portion on turntable 102 is removed prior to beginning the operation. Also, the "housekeeping" program independently steps the stepper motors 299, 300 to the start position to assure that the gate/pushers 280–280" of the assemblies 220, 222 are properly aligned. The program services the keyboard entries (from panels 508 and 516) at 534. If no keyboard entries have been made, they are entered into the microprocessor which then updates the dated displays at 536. At 538, the microprocessor updates and displays the paper total, i.e. the total number of signatures processed to date.

Thereafter, at 540, control of the turntable 102 and pusher/gates 280–280" is performed by the microprocessor. The microprocessor then loops back to step 534 and continuously services the keyboard displays, table pusher and stacking sections in a repetitive fashion.

The elapsed time after initiation of the turn command is accumulated. The accumulated elapsed time is compared against a stored value when the home position sensor 370 and 372 (FIG. 1) senses completion of a half-turn to determine if the turn has been completed within an acceptable time interval. The accumulated time is also periodically compared with the stored value to initiate a jam condition if the elapsed time is greater than the stored value. A similar operation is performed for each push operation.

The microprocessor 502 further includes a real time clock which initiates an interrupt of the normal routine at 550 every two milliseconds. Upon initiation of an interrupt at 552 the timers are incremented and the input/output buffer is serviced. This step more specifically includes incrementing timers used to monitor stacking functions such as time at home position; time of turn operation; time of push operation. These accumulated time values are compared against stored values to be assured of proper operation. For example, if the push operation is not completed within a predetermined time interval this indicates a further condition which may initiate a halt operation. This is also true of the turn operation.

The stacking section is controlled at 553, the data relating to paper rate is processed at 554 and the infeed speed and paper distance data is processed at 556.

The pulses accumulated for each signature whose passage is detected by signature counter 24 are accumulated and maintained in appropriate memory locations at step 558.

The next step to be performed in the normal software routine is stored at the initiation of the interrupt represented at 550 in FIG. 6. When the interrupt routine is terminated, at 560, the microprocessor exits from the interrupt routine and returns to the next program step to be performed in the normal routine by returning to the program step whose location was stored in memory at step 550 of the real time clock interrupt routine. The interrupt routine is repeated every two milliseconds and performs in the same manner as described hereinabove.

A summary of the operation of the stacker controller will now be set forth (limited to controlling the turntable assembly), making reference to the Figs.

A stacking platform shown in copending application Ser. No. 707,494 filed Mar. 1, 1985, now U.S. Pat. No. 4,678,387 which contains a completed signature stack begins to move out from beneath the completed signature stack allowing the completed signature stack to drop to the turntable 102. this drop is represented by waveform 610 which, at time $t_1$ indicates the position of the stack as being of the order of 23 inches above the turntable 102 at point **610*a*. The just completed stack hits turntable 102 at point 610*c*. At point 610*b* intermediate end points 610*a* and 610*c*, rotation of turntable 102** must be completed to prevent the moving sidewalls from interfering with the drop of the completed stack of signatures.

At time $t_2$ an execute turn command, as represented by pulse 612, is generated by the microprocessor. This command is generated when a predetermined number of distance counts have been accumulated. The time occurence of this count varies as a function of the stacking section speed. For example, if the stacking section speed is greater than the nominal value, the count at which the execute turn command is generated will occur earlier than time $t_2$, and vice versa. The actual turn begins at time $t_3$ as represented by pulse 614. The time required to rotate turntable 102 is fixed and, in the preferred embodiment the turntable ideally completes a one-half turn in an elapsed time of 0.7 seconds and, as a practical matter should complete the turn in 0.82 seconds.

The stacking platform as was mentioned hereinabove, starts to release the completed signature stack (by moving out from beneath the stack) about time $t_3$.

The push operation is initiated either after the last stack forming a compensated bundle has been delivered to the turntable 102 or when a bundle of only a single signature stack is to be formed. At this time no turn operation is either required or performed. At time $t_2$, the push command 616 is executed based upon accumulation of a predetermined number of distance counts and when the number of stacks reach a preset count (i.e. one or more than one). Due to the inherent delays in the mechanical components utilized to perform the push operation, the actual push operation begins at time $t_4$ which is a predetermined delay interval after the execute push command. The microprocessor 502 applies an ascending ramp signal to each indexer **520*a*, 520*b* for driving two driver circuits 566, 568 in common, which driver circuits respectively drive stepper motors 299, 300 (see FIG. 5*a*) causing the gate/pushers to accelerate from 0 velocity at time $t_4$ as shown by curve portion 618*a* to a constant velocity initiated at time $t_5$. The gate/pushers are moved at the constant velocity until time $t_6$ as represented by curve portion 618*b*. At time $t_6$, the microprocessor applies a descending ramp signal through indexer 520*a*, 520*b* and drive circuits 566, 568 to the gate/pusher stepper motors 299, 300 causing the gate/pushers to decelerate until time $t_7$. The descending ramp signals are generated by the drive circuits 566, 568 responsive to the indexers 520*a*, 520*b* to bring the gate/-pushers to a halt position. If the gate/pusher is not at the home positin at that time the CPU 502 sets a timer and moves the stepper motors 299, 300** at synchronized speed. If the timer times out before the gate/pusher arrives at the home position the stacker is shut down.

The interrupt test generator 512 shown in FIG. 5 runs the stacker through a test sequence by simulating a press input rate of (A)×1,OOO signatures per hour, the number A being a real number to select an input rate between 10,000 and 80,000 papers per hhour. In the test mode only the speed distance and the paper pulses are simulated by the microprocessor, all other functions occur in real time.

In the preferred embodiment the major components employed are as follows:

INDEXER - Model STD-3008, MANUFACTURER - WHEDCO, INC.

DRIVER - 3043M Series (Biopolar Chopper Driver), SIGMA INSTRUMENTS, INC.

SS MOTOR - 802D4254B02K, SIGMA INSTRUMENTS, INC.

PUSH MOTORS - 802D4280B03, SIGMA INSTRUMENTS, INC.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed:

1. A turntable assembly for forming signature bundles and the like, comprising:

a turntable;

means for rotatably mounting said turntable for receiving stacks of signatures dropped upon said turntable;

a pair of moving wall means arranged in spaced parallel fashion on said turntable receiving and embracing opposite parallel sides of signatures to support said signatures in an upright manner therebetween;

each of said moving wall means including a plurality of gate/pusher members arranged at spaced intervals about the moving wall means, selected ones of said gate/pusher members of both of said moving wall means extending toward one another to embrace the sides of the signatures perpendicular to those sides embraced by the moving wall means;

first and second motors secured to the underside of said turntable for respectively moving an associated one of said moving wall means for pushing signatures off the platform by at least one of the gate/pushers of each of said moving wall means;

each of said moving wall means including means driven by one of said motors, for moving said moving wall means;

each of said motors having an output shaft, the longitudinal axis of each output shaft lying on a first imaginary line which passes through the center of rotation of said turntable.

2. The apparatus of claim 1 wherein said motors are stepper motors.

3. The apparatus of claim 1 wherein each moving wall means includes a driven pulley, the axis of rotation of said driven pulleys in each of said moving wall means lying along a second imaginary line which passes through the axis of rotation of said turntable.

4. The apparatus of claim 3 wherein said first and second imaginary lines are angularly offset relative to one another.

5. The apparatus of claim 4 wherein the axes of rotation of each motor output shaft and the associated driven pulley lie along third and fourth imaginary lines respectively, and are parallel to one another, the center of rotation of said turntable lying midway between said third and fourth imaginary lines.

6. The apparatus of claim 1 wherein said means for rotatably mounting said turntable includes a hollow support member having openings on opposite sides thereof;

the electrical leads of said stepper motors exending through said openings and downwardly substantially along the longitudinal axis of said hollow member and through the bottom end thereof for connection to a control circuit;

the longitudinal axis of said hollow member being coincident with the center of rotation of said turntable.

7. The apparatus of claim 1 wherein each of said driven members of said pair of moving wall means comprising a timing pulley;

the output of each motor means having a timing pulley mounted thereon;

timing belt means for coupling each motor means timing pulley to the driven timing pulley of its associated moving wall means.

8. The apparatus of claim 7 further comprising a mounting assembly for adjustably mounting each motor means to the underside of said turntable for adjusting the tension of the associated timing belt.

9. The apparatus of claim 8 wherein each of said adjustable mounting assemblies comprises a pair of elongated plates of L-shaped cross-section being secured to the underside of said turntable;

a pair of elongated plates having a first one of its elongated ends inserted into the recess between one arm of said L-shaped member and the underside of said turntable while the other one of its elongated ends extends toward the center of said turntable;

means for releasably securing said elongated plates to said L-shaped arms;

a platform plate and spacer means for securing said platform plate to said first and second elongated plates;

said motor means having a mounting flange and means for securing the mounting flange to said platform plate;

said platform plate having a central opening through which the output shaft of said motor means extends;

said pulley being mounted to the free end of said output shaft;

first and second means movably mounted upon the underside of said turntable for engaging one end of an associated one of said elongated plates for adjusting the position of each of said elongated plates, said elongated plates being locked in place by said releasable fastening means.

10. The adjustable mounting apparatus of claim 9 wherein said adjustable means further comprise an elongated block secured to the underside of said turntable, said elongated block having first and second tapped openings;

first and second threaded bolts threadedly engaging said tapped openings and each having free ends extending toward and engaging the adjacent ends of said elongated plates whereby, by adjusting said bolts and pressing the ends of said elongated plates against the free ends of said bolts, the motor secured to said platform plate may be adjustably positioned to maintain said timing belt under proper tension.

11. The apparatus of claim 10 wherein the releasable fastening means for securing said elongated plates to said L-shaped members extend through elongated openings in said L-shaped members and threadedly engage tapped openings in said elongated plates whereby to retain the elongated plates in position with their ends firmly engaging the free ends of said adjustment bolts.

12. The apparatus of claim 1 further comprising electronic digital solid state control means for generating signals to obtain the desired velocity profile for movement of said gate/pusher members being coupled to said motors.

13. The apparatus of claim 12 wherein said motors each comprise a stepper motor and further including indexer means coupled to said control means and a drive circuit coupled between said indexer means and said stepper motor.

14. The apparatus of claim 12 wherein said motors each comprise a stepper motor and further including indexer means coupled to said control means and first and second drivė circuits coupled in common to the indexer means and having their outputs coupled to the stepper motor.

15. The apparatus of claim 13 wherein said control means comprises a microprocessor including read-only memory (ROM) means for storing the program steps utilized to control the velocity profile for movement of the pusher/gate member.

16. The apparatus of claim 15 further comprising sensor means for sensing the location of said gate/pushers;

said control means including means responsive to said sensor means for operating said stepper means to correct any misalignment of the gate/pusher member.

17. The apparatus of claim 16 further comprising means operative upon initial energization of said control means for operating said gate/pusher members through one complete cycle and for aligning said gate/pusher members in readiness for stacking operations.

18. The apparatus of claim 1 further comprising means coupled to said turntable for rotating said turntable through one-half revolution.

19. The apparatus of claim 18 wherein said rotating means comprises air cylinder means.

20. The apparatus of claim 19 further comprising damping means coupled to said turntable for retarding the rotational movement of the turntable during the latter portion of its rotation through one-half revolution while permitting the rotational movement of the turntable during the first part of its rotation through one-half revolution.

21. The apparatus of claim 19 wherein said rotating means comprises a first cylindrical member secured to the structural frame supporting the turntable;

a second cylindrical member rotatably mounted within said first cylindrical member by bearing means;

the top end of said inner cylindrical member being secured to and rotatably supporting said turntable;

said inner cylindrical member having openings for receiving electrical leads from said first and second motor means for extending the leads thereof downwardly along the central axis of said inner cylindrical member for coupling to a control circuit;

said electrical leads being substantially aligned with the axis of rotation of said inner cylindrical member;

the axis of rotation of said inner cylindrical member being coincident with the center of rotation of said turntable.

22. The apparatus of claim 21 wherein said means for rotating said turntable through one-half revolution is coupled to said inner cylindrical member.

23. The apparatus of claim 22 wherein said means for rotating said turntable through one half revolution comprises a cylinder coupled between said structural frame and said inner cylindrical member.

24. The apparatus of claim 23 further comprising sensing means for sensing identification means arranged at spaced intervals about said turntable for controlling the operation of said means for rotating said turntable through one-half revolution.

25. The apparatus of claim 24, wherein said sensing means comprises first and second sensors and said identification means are arranged at 90° intervals about the periphery of said turntable and have targets for causing said sensors to develop binary signals which are different for each identification means.

* * * * *